US008584294B2

(12) United States Patent
Loring

(10) Patent No.: US 8,584,294 B2
(45) Date of Patent: Nov. 19, 2013

(54) FLOOR CLEANER SCRUB HEAD HAVING A MOVABLE DISC SCRUB MEMBER

(75) Inventor: Peter Alexander Loring, Robbinsdale, MN (US)

(73) Assignee: Tennant Company, Minneapolis, MN (US)

( * ) Notice: Subject to any disclaimer, the term of this patent is extended or adjusted under 35 U.S.C. 154(b) by 1687 days.

(21) Appl. No.: 11/256,475

(22) Filed: Oct. 21, 2005

(65) Prior Publication Data

US 2007/0089251 A1 Apr. 26, 2007

(51) Int. Cl.
*A47L 11/283* (2006.01)

(52) U.S. Cl.
USPC ..... 15/49.1; 15/50.1

(58) Field of Classification Search
USPC ..... 15/49.1, 50.1
See application file for complete search history.

(56) References Cited

U.S. PATENT DOCUMENTS

| | | | | |
|---|---|---|---|---|
| 2,563,151 | A | 8/1951 | Bjorksten | 134/111 |
| 2,731,659 | A | 12/1952 | Coplen | 15/320 |
| 3,037,887 | A | 5/1959 | Brenner et al. | 134/22 |
| 2,993,494 | A | 7/1961 | Svensson | 134/169 |
| 3,078,190 | A | 2/1963 | Blaser et al. | 134/10 |
| 3,162,427 | A | 12/1964 | Knudson et al. | 259/4 |
| 3,212,762 | A | 10/1965 | Carroll | 261/124 |
| 3,231,134 | A | 1/1966 | Webster | 222/1 |
| 3,392,418 | A | 7/1968 | Schowalter | 15/320 |
| 3,436,262 | A | 4/1969 | Crowe et al. | 134/10 |
| 3,453,678 | A | 7/1969 | Gehman et al. | 15/50 |
| 3,456,279 | A | 7/1969 | Koland | 15/320 |
| 3,460,717 | A | 8/1969 | Thomas | 15/320 |
| 3,490,948 | A | 1/1970 | Farison | 134/36 |
| 3,535,162 | A | 10/1970 | Bray et al. | 134/42 |
| 3,549,420 | A | 12/1970 | Cunningham | 134/22 |
| 3,655,096 | A | 4/1972 | Easter | 222/82 |
| 3,676,889 | A | 7/1972 | Edlin | 15/320 |
| 3,761,987 | A | 10/1973 | Nayfa et al. | 15/50 |
| 3,774,262 | A | 11/1973 | Anthony et al. | 15/322 |
| 3,789,449 | A | 2/1974 | MacFarland et al. | 15/4 |

(Continued)

FOREIGN PATENT DOCUMENTS

| | | |
|---|---|---|
| DE | 94 04 369 U1 | 6/1994 |
| DE | 44 13 783 A1 | 3/1995 |

(Continued)

OTHER PUBLICATIONS

Extended European Search Report of Application No. 06255416.7 filed Oct. 20, 2006. Date Mailed: Mar. 9, 2007.

(Continued)

*Primary Examiner* — Mark F Huff
*Assistant Examiner* — Monique Wills
(74) *Attorney, Agent, or Firm* — Brian D. Kaul; Westman, Champlin & Koehler, P.A.

(57) ABSTRACT

A scrub head includes a first disc scrub member, a movable support having first and second positions, and a movable disc scrub member. The first disc scrub member is rotatable about a first vertical axis. The movable disc scrub member is rotatable about a second vertical axis and is connected to the movable support. The movable disc scrub member is configured to move relative to the first disc scrub member along first and second orthogonal axes of a horizontal plane, which is transverse to the first and second vertical axes, between first and second positions respectively corresponding to the first and second positions of the movable support.

23 Claims, 6 Drawing Sheets

(56) References Cited

U.S. PATENT DOCUMENTS

| | | | | |
|---|---|---|---|---|
| 3,823,727 | A | 7/1974 | Fry | 137/88 |
| 3,931,662 | A | 1/1976 | Nayfa et al. | 15/320 |
| 3,938,212 | A | 2/1976 | Krier et al. | 15/50 |
| 3,940,826 | A | 3/1976 | Phillips et al. | 15/320 |
| 3,942,218 | A | 3/1976 | Krier et al. | 15/340 |
| 3,974,541 | A | 8/1976 | Silvis et al. | 15/320 |
| 3,979,789 | A | 9/1976 | Peabody et al. | 15/349 |
| 4,000,536 | A | 1/1977 | Nayfa et al. | 15/50 |
| 4,014,808 | A | 3/1977 | Herpers, Jr. et al. | 252/135 |
| 4,032,307 | A | 6/1977 | Sommerfeld | 55/96 |
| 4,037,289 | A | 7/1977 | Dojan | 15/320 |
| D245,994 | S | 10/1977 | Olson | D23/162 |
| 4,061,001 | A | 12/1977 | Von der Eltz et al. | 68/200 |
| 4,096,084 | A | 6/1978 | Thomsen et al. | 252/173 |
| 4,099,285 | A | 7/1978 | Christensen et al. | 15/83 |
| 4,107,075 | A | 8/1978 | Kramer | 252/359 |
| 4,133,773 | A | 1/1979 | Simmons | 252/359 |
| 4,138,756 | A | 2/1979 | Krier et al. | 15/83 |
| RE29,957 | E | 4/1979 | Kasper | 15/83 |
| 4,167,798 | A | 9/1979 | Klugl et al. | 15/320 |
| 4,167,799 | A | 9/1979 | Webb | 15/320 |
| 4,173,056 | A | 11/1979 | Geyer | 15/320 |
| 4,191,590 | A | 3/1980 | Sundheim | 134/21 |
| 4,194,263 | A | 3/1980 | Herpers et al. | 15/353 |
| 4,206,530 | A | 6/1980 | Kroll et al. | 15/340 |
| 4,210,978 | A | 7/1980 | Johnson et al. | 15/320 |
| D257,845 | S | 1/1981 | Peabody et al. | D15/50 |
| 4,258,451 | A | 3/1981 | Sommerfeld | 15/352 |
| 4,262,382 | A | 4/1981 | Brown et al. | 15/49 |
| 4,295,244 | A | 10/1981 | Herpers et al. | 15/320 |
| 4,310,944 | A | 1/1982 | Kroll et al. | 15/346 |
| 4,320,556 | A | 3/1982 | Kimzey et al. | 15/347 |
| 4,334,335 | A | 6/1982 | Brown et al. | 15/319 |
| 4,345,353 | A | 8/1982 | Sommerfeld | 15/349 |
| 4,346,494 | A | 8/1982 | Peabody et al. | 15/179 |
| 4,348,783 | A | 9/1982 | Swanson et al. | 15/320 |
| 4,355,435 | A | 10/1982 | Kimzey et al. | 15/347 |
| 4,365,189 | A | 12/1982 | Hawkins et al. | 318/284 |
| 4,369,544 | A | 1/1983 | Parisi | 15/320 |
| D267,824 | S | 2/1983 | Mannelly | D32/16 |
| 4,373,227 | A | 2/1983 | Kimzey et al. | 15/347 |
| 4,377,017 | A | 3/1983 | Herpers et al. | 15/320 |
| 4,378,855 | A | 4/1983 | Haub et al. | 180/65 |
| 4,393,538 | A | 7/1983 | Olson | 15/320 |
| 4,419,141 | A | 12/1983 | Kunkel | 134/22.12 |
| 4,429,432 | A | 2/1984 | Copeland et al. | 15/320 |
| D273,620 | S | 4/1984 | Kimzey et al. | D32/16 |
| D273,621 | S | 4/1984 | Haub et al. | D32/16 |
| D273,622 | S | 4/1984 | Brown et al. | D32/16 |
| 4,457,036 | A | 7/1984 | Carlson et al. | 15/49 |
| 4,511,486 | A | 4/1985 | Shah | 252/90 |
| 4,557,739 | A | 12/1985 | Fortman et al. | 55/320 |
| 4,570,856 | A | 2/1986 | Groth et al. | 239/310 |
| 4,571,771 | A | 2/1986 | Worwa | 15/319 |
| 4,580,313 | A | 4/1986 | Blehert | 15/349 |
| 4,586,208 | A | 5/1986 | Trevarthen | 8/158 |
| 4,595,420 | A | 6/1986 | Williams, III et al. | 134/6 |
| 4,608,086 | A | 8/1986 | Dodge | 106/12 |
| 4,615,070 | A | 10/1986 | Frederick et al. | 15/339 |
| 4,624,026 | A | 11/1986 | Olson et al. | 15/340 |
| 4,634,403 | A | 1/1987 | Peabody et al. | 474/1 |
| 4,667,364 | A | 5/1987 | Meili | 15/320 |
| 4,675,935 | A | 6/1987 | Kasper et al. | 15/319 |
| 4,676,287 | A | 6/1987 | Fitzwater | 141/285 |
| 4,676,926 | A | 6/1987 | Kappler | 252/307 |
| 4,679,271 | A | 7/1987 | Field et al. | 15/49 |
| 4,709,771 | A | 12/1987 | Basham et al. | 180/6.5 |
| 4,729,141 | A | 3/1988 | Berg et al. | 15/49 |
| 4,757,566 | A | 7/1988 | Field et al. | 15/49 |
| 4,768,311 | A | 9/1988 | Olson | 51/174 |
| 4,780,243 | A | 10/1988 | Edgley et al. | 252/307 |
| 4,805,256 | A | 2/1989 | Mason et al. | 15/320 |
| 4,805,258 | A | 2/1989 | Sitarski et al. | 15/385 |
| 4,817,233 | A | 4/1989 | Waldhauser | 15/320 |
| 4,819,676 | A | 4/1989 | Blehert et al. | 134/21 |
| 4,822,431 | A | 4/1989 | Bricher et al. | 134/28 |
| 4,831,684 | A * | 5/1989 | Duncan | 15/340.1 |
| 4,838,457 | A | 6/1989 | Swahl et al. | 222/48 |
| 4,849,027 | A | 7/1989 | Simmons | 134/22.18 |
| 4,866,804 | A | 9/1989 | Masbruch et al. | 15/49 |
| 4,881,288 | A | 11/1989 | May et al. | 15/98 |
| 4,903,718 | A | 2/1990 | Sullivan | 134/184 |
| 4,913,316 | A | 4/1990 | Richter | 221/1 |
| 4,967,064 | A | 10/1990 | Field et al. | 250/203.2 |
| 4,974,618 | A | 12/1990 | Nysted | 134/21 |
| 4,986,378 | A | 1/1991 | Kasper | 180/6.48 |
| 4,996,468 | A | 2/1991 | Field et al. | 318/587 |
| 5,013,333 | A | 5/1991 | Beaufoy et al. | 55/21 |
| 5,016,310 | A | 5/1991 | Geyer et al. | 15/49.1 |
| 5,031,837 | A | 7/1991 | Hanish | 239/267 |
| 5,044,043 | A | 9/1991 | Basham et al. | 15/319 |
| 5,045,118 | A | 9/1991 | Mason et al. | 134/21 |
| 5,060,342 | A | 10/1991 | Brazier | 15/322 |
| 5,064,010 | A | 11/1991 | Mashbruch et al. | 180/6.5 |
| 5,088,149 | A | 2/1992 | Berg et al. | 15/322 |
| 5,093,955 | A | 3/1992 | Blehert et al. | 15/320 |
| RE33,926 | E | 5/1992 | Waldhauser | 15/320 |
| 5,116,425 | A | 5/1992 | Ruef | 134/17 |
| 5,133,107 | A | 7/1992 | MacDonald | 15/50.3 |
| 5,207,642 | A | 5/1993 | Orkin et al. | 604/65 |
| 5,212,848 | A | 5/1993 | Geyer | 15/401 |
| 5,213,120 | A | 5/1993 | Dickson | 134/102.1 |
| 5,231,725 | A | 8/1993 | Hennessey et al. | 15/83 |
| 5,244,003 | A | 9/1993 | Boomgaarden | 137/1 |
| 5,254,146 | A | 10/1993 | Beaufoy | 55/320 |
| 5,265,300 | A * | 11/1993 | O'Hara et al. | 15/49.1 |
| 5,276,933 | A | 1/1994 | Hennessey et al. | 15/83 |
| 5,295,277 | A | 3/1994 | Koenigs et al. | 15/83 |
| 5,303,448 | A | 4/1994 | Hennessey et al. | 15/340.3 |
| 5,319,828 | A | 6/1994 | Waldhauser et al. | 15/320 |
| 5,383,605 | A | 1/1995 | Teague | 239/526 |
| RE35,033 | E | 9/1995 | Waldhauser | 15/320 |
| 5,455,985 | A | 10/1995 | Hamline et al. | 15/401 |
| 5,462,607 | A | 10/1995 | Mestetsky et al. | 134/22.12 |
| 5,483,718 | A | 1/1996 | Blehert et al. | 15/50.3 |
| 5,509,972 | A | 4/1996 | Akazawa et al. | 134/26 |
| 5,515,568 | A | 5/1996 | Larson et al. | 15/50.3 |
| 5,526,547 | A | 6/1996 | Williams et al. | 15/320 |
| 5,566,422 | A | 10/1996 | Geyer | 15/320 |
| 5,593,091 | A | 1/1997 | Harris | 239/127 |
| 5,647,093 | A | 7/1997 | Engel et al. | 15/352 |
| 5,649,643 | A | 7/1997 | Ridgeway | 222/105 |
| 5,659,921 | A | 8/1997 | Narayan | 15/349 |
| 5,711,775 | A | 1/1998 | Field et al. | 55/273 |
| 5,735,017 | A | 4/1998 | Barnes et al. | 15/321 |
| 5,738,248 | A | 4/1998 | Green | 222/129.2 |
| 5,813,086 | A | 9/1998 | Ueno et al. | 15/320 |
| 5,816,298 | A | 10/1998 | Stricklin et al. | 141/346 |
| 5,829,094 | A | 11/1998 | Field et al. | 15/352 |
| 5,836,045 | A | 11/1998 | Anthony et al. | 15/320 |
| 5,853,814 | A | 12/1998 | Murphy | 427/434.6 |
| 5,871,152 | A | 2/1999 | Saney | 239/8 |
| 5,884,353 | A | 3/1999 | Berg et al. | 15/83 |
| 5,893,189 | A | 4/1999 | D'Costa | 15/83 |
| 5,901,407 | A | 5/1999 | Boomgaarden | 15/320 |
| 5,940,928 | A | 8/1999 | Erko | 15/319 |
| 5,940,929 | A | 8/1999 | Berg | 15/334 |
| 5,943,724 | A | 8/1999 | Erko et al. | 15/49.1 |
| 5,943,730 | A | 8/1999 | Boomgaarden | 15/320 |
| 5,967,747 | A | 10/1999 | Burke et al. | 415/206 |
| 5,983,447 | A | 11/1999 | Boomgaarden | 15/354 |
| 5,991,953 | A | 11/1999 | Durenberger et al. | 15/83 |
| 5,996,173 | A | 12/1999 | Engel et al. | 15/352 |
| 5,996,174 | A | 12/1999 | Boomgaarden et al. | 15/354 |
| 6,003,186 | A | 12/1999 | Larson | 15/82 |
| 6,017,163 | A | 1/2000 | Keppers et al. | 401/48 |
| 6,018,844 | A | 2/2000 | Basham et al. | 15/349 |
| 6,035,479 | A | 3/2000 | Basham et al. | 15/83 |
| 6,073,295 | A | 6/2000 | Durenberger et al. | 15/83 |
| 6,090,217 | A | 7/2000 | Kittle | 134/11 |
| 6,092,261 | A | 7/2000 | Boomgaarden | 15/323 |
| 6,117,200 | A | 9/2000 | Berg et al. | 55/287 |
| 6,125,495 | A | 10/2000 | Berg et al. | 15/183 |
| 6,131,766 | A | 10/2000 | King et al. | 222/1 |

(56) References Cited

U.S. PATENT DOCUMENTS

| | | | | |
|---|---|---|---|---|
| 6,192,542 | B1 | 2/2001 | Frederick et al. | 15/84 |
| 6,202,243 | B1 | 3/2001 | Beaufoy et al. | 15/49.1 |
| 6,209,756 | B1 | 4/2001 | Van Der Heijden | 222/105 |
| 6,249,926 | B1 | 6/2001 | Wulff | 15/50.1 |
| 6,276,613 | B1 | 8/2001 | Kramer | 239/304 |
| 6,283,221 | B2 | 9/2001 | Hurray et al. | 169/30 |
| 6,286,169 | B1 | 9/2001 | D'Costa et al. | 15/52.1 |
| 6,389,641 | B1 | 5/2002 | Boomgaarden et al. | 15/340.1 |
| 6,398,829 | B1 | 6/2002 | Shinler et al. | 55/317 |
| 6,401,294 | B2 | 6/2002 | Kasper | 15/320 |
| 6,418,586 | B2 | 7/2002 | Fulghum | 15/320 |
| 6,421,870 | B1 | 7/2002 | Basham et al. | 15/83 |
| 6,425,958 | B1 | 7/2002 | Giddings et al. | 134/21 |
| 6,428,590 | B1 | 8/2002 | Lehman et al. | 55/334 |
| 6,449,793 | B2 | 9/2002 | D'Costa et al. | 15/52.1 |
| 6,505,379 | B2 | 1/2003 | Keller | 15/339 |
| 6,507,968 | B1 | 1/2003 | Hansen | 15/49.1 |
| 6,523,992 | B1 | 2/2003 | Bublewitz et al. | 366/172.1 |
| 6,530,102 | B1 | 3/2003 | Pierce et al. | 15/52.1 |
| 6,543,580 | B1 | 4/2003 | Gathmann et al. | 184/7.4 |
| 6,585,827 | B2 | 7/2003 | Field et al. | 134/6 |
| 6,602,018 | B2 | 8/2003 | Feeny et al. | 403/227 |
| 6,614,195 | B2 | 9/2003 | Bushey et al. | 318/135 |
| 6,618,888 | B2 | 9/2003 | Joynt et al. | 15/49.1 |
| 6,651,286 | B2 | 11/2003 | Pierce | 15/98 |
| 6,662,402 | B2 | 12/2003 | Giddings et al. | 15/320 |
| 6,662,600 | B1 | 12/2003 | Field et al. | 68/17 |
| D485,175 | S | 1/2004 | Field et al. | D9/432 |
| 6,671,925 | B2 | 1/2004 | Field et al. | 15/320 |
| 6,705,332 | B2 | 3/2004 | Field et al. | 134/102.1 |
| 6,735,811 | B2 | 5/2004 | Field et al. | 15/320 |
| 6,735,812 | B2 | 5/2004 | Hekman et al. | 15/320 |
| 6,742,219 | B2 | 6/2004 | Lenzmeier et al. | 15/345 |
| 6,802,098 | B2 | 10/2004 | Geyer et al. | 15/52.1 |
| 6,836,919 | B2 | 1/2005 | Shinler | 15/78 |
| 6,877,180 | B2 | 4/2005 | Wilmo et al. | 15/83 |
| 2001/0022010 | A1 | 9/2001 | Kasper | 15/320 |
| 2002/0096258 | A1 | 7/2002 | Savas et al. | 156/345.48 |
| 2002/0179116 | A1 | 12/2002 | Shinler | 134/6 |
| 2003/0019071 | A1 | 1/2003 | Field et al. | 15/320 |
| 2003/0029885 | A1 | 2/2003 | Kawolics et al. | 222/105 |
| 2004/0040102 | A1 | 3/2004 | Field et al. | 15/50.1 |
| 2004/0187895 | A1 | 9/2004 | Field et al. | 134/26 |
| 2004/0221407 | A1 | 11/2004 | Field et al. | 15/50.1 |

FOREIGN PATENT DOCUMENTS

| | | |
|---|---|---|
| EP | 0 744 148 A2 | 11/1996 |
| EP | 1 044 645 A2 | 10/2000 |
| EP | 0 945 551 B1 | 6/2003 |
| JP | 11216092 | 8/1999 |
| WO | WO 95/09557 | 4/1995 |
| WO | WO 00/35333 | 6/2000 |
| WO | WO 02/05047 | 1/2002 |
| WO | WO 02/06435 | 1/2002 |

OTHER PUBLICATIONS

Discover Magazine, Jun. 2002, "Does the Universe Exist if We Don't Observe It?", including cover, Table of Contents, and pp. 26 and 27.
U.S. Appl. No. 11/125,764, filed May 10, 2005.
U.S. Appl. No. 11/211,987, filed Aug. 25, 2005.

* cited by examiner

FLOOR CLEANER SCRUB HEAD HAVING A MOVABLE DISC SCRUB MEMBER

FIELD OF THE INVENTION

The present invention is generally directed to scrub heads of floor cleaners and, more particularly, to a scrub head having a movable disc scrub member.

BACKGROUND OF THE INVENTION

In the design of industrial floor cleaners, it is common to mount scrub members (i.e., scrub brushes or pads) and their drive motors in an assembly called a scrub head. The scrub head generally spans a width of the cleaner and can be mounted in front of, underneath amidships, or behind the machine frame. The scrub head is commonly attached in some articulated manner to the frame of the machine so that the scrub members can be raised for transport and lowered to the floor to perform cleaning operations.

During floor cleaning operations, water or cleaning liquid is applied to the floor either in front of or at the scrub head. The scrub members scrub the wetted floor to remove dirt from the floor. A vacuumized squeegee, located behind the scrub head, operates to remove the soiled liquid from the floor.

The scrub members often wear quickly and must be inspected on a regular basis to determine whether they require replacement. Scrub members positioned adjacent the sides of the cleaner are generally easily accessible making for easy inspection and replacement of those members.

However, for some floor cleaners, particularly larger cleaners that include one or more scrub brushes that are centrally positioned beneath the cleaner, inspecting the scrub brushes can be cumbersome. In general, the operator must either raise the cleaner on a lift, or get down on the floor and partially underneath the cleaner to reach the centrally located scrub members. Additionally, the operator must often feel for the mechanism that releases the scrub member from the scrub head since it is difficult to visually locate it when lying underneath the cleaner.

Embodiments of the present invention provide solutions to these and other problems, and offer other advantages over the prior art.

The discussion above is merely provided for general background information and is not intended to be used as an aid in determining the scope of the claimed subject matter.

SUMMARY OF THE INVENTION

The present invention is generally directed to a scrub head of a floor cleaner. The scrub head includes a first disc scrub member, a movable support having first and second positions, and a movable disc scrub member. The first disc scrub member is rotatable about a first vertical axis. The movable disc scrub member is rotatable about a second vertical axis and is connected to the movable support. The movable disc scrub member is configured to move relative to the first disc scrub member along first and second orthogonal axes of a horizontal plane, which is transverse to the first and second vertical axes, between first and second positions respectively corresponding to the first and second positions of the movable support.

Other features and benefits that characterize embodiments of the present invention will be apparent upon reading the following detailed description and review of the associated drawings.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

DETAILED DESCRIPTION

Figure 1:
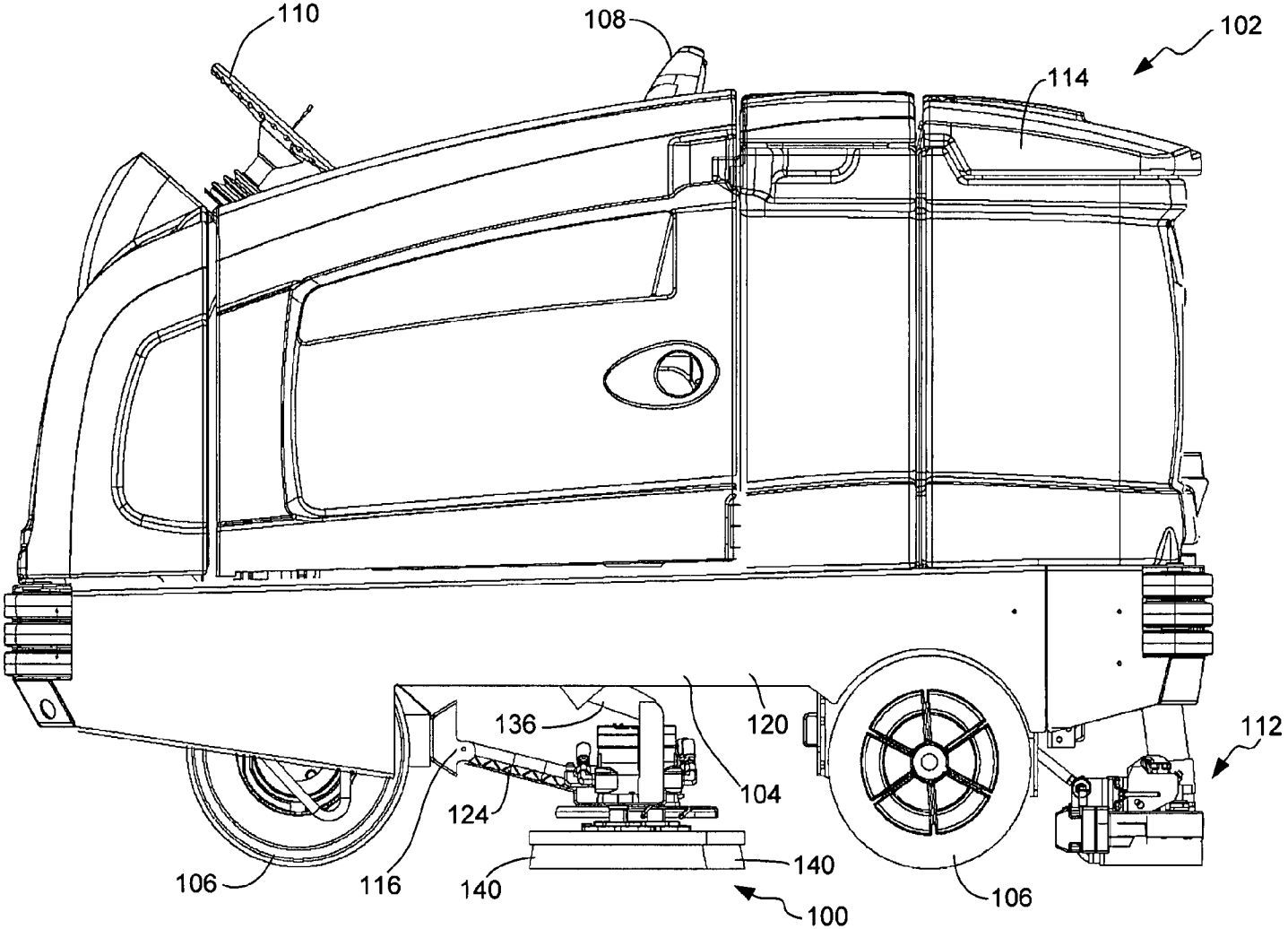
FIG. 1 is a side view of a floor cleaner in accordance with embodiments of the invention.

The present invention is generally directed to a scrub head 100 for use with an industrial floor cleaner, such as a ride-behind or walk-behind floor scrubber or sweeper/scrubber machine. FIG. 1 is a schematic diagram of an exemplary floor cleaner 102 in accordance with embodiments of the invention that includes the scrub head 100 with a side wall removed to expose the scrub head 100.

Figure 2:
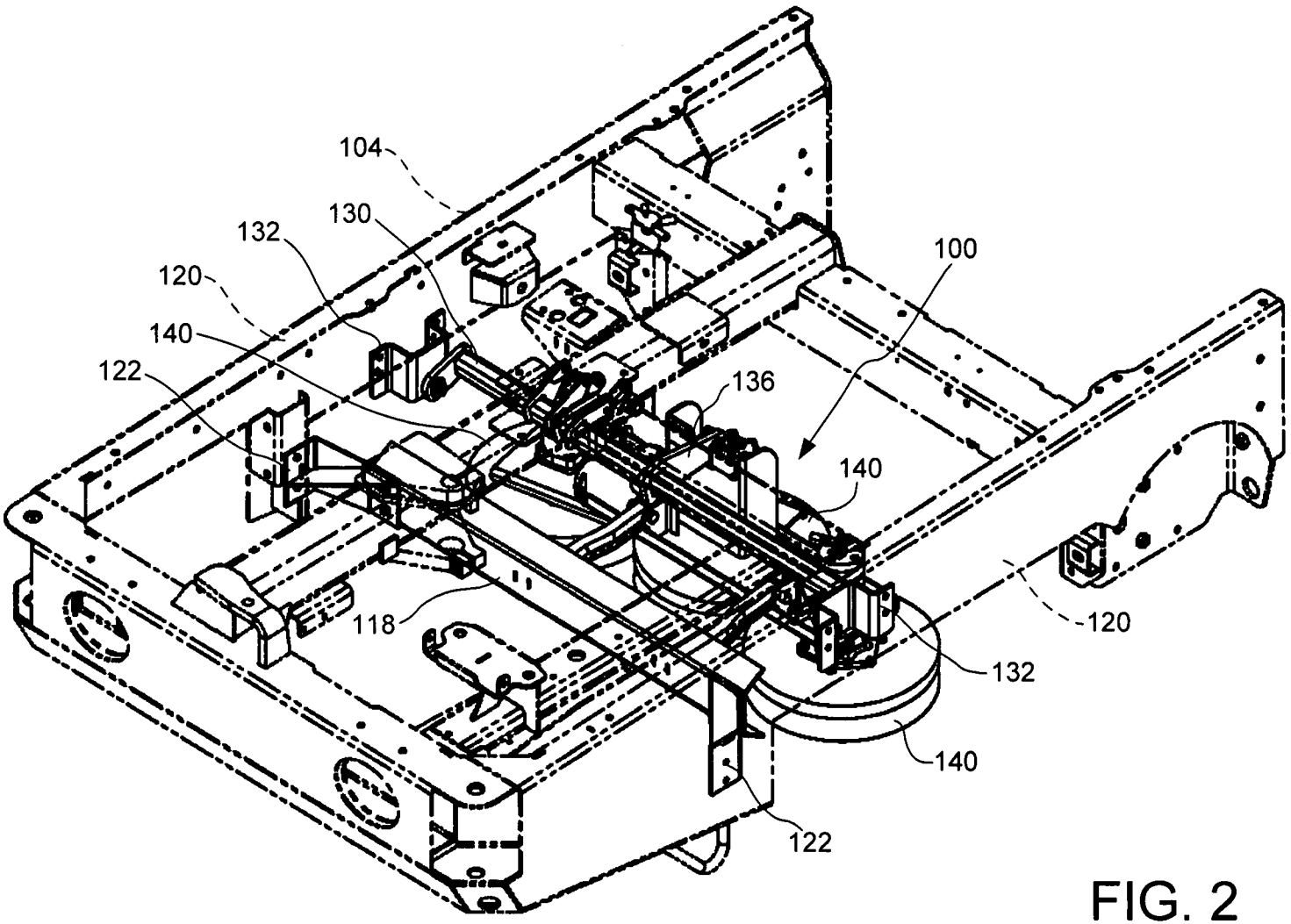
FIG. 2 is a perspective view of a scrub head mounted to a frame (depicted in phantom lines) of a cleaner, in accordance with embodiments of the invention.

The floor cleaner 102 includes a mobile body having a frame 104 that supports the various machine components including the scrub head 100 of the present invention, as shown in FIG. 2. The frame 104 is supported on wheels 106. The wheels can include one or two steerable front wheels and two rear wheels, for example. The front or rear wheels 106 are driven by a motor in accordance with conventional methods. The cleaner 102 also includes a seat 108 for an operator, a steering wheel 110 and suitable controls. A vacuum pickup squeegee 112 is positioned behind the scrub head 100 and is used to remove soiled cleaning solution from the floor. Tanks 114 are used to store clean and soiled cleaning solution.

Figure 3:
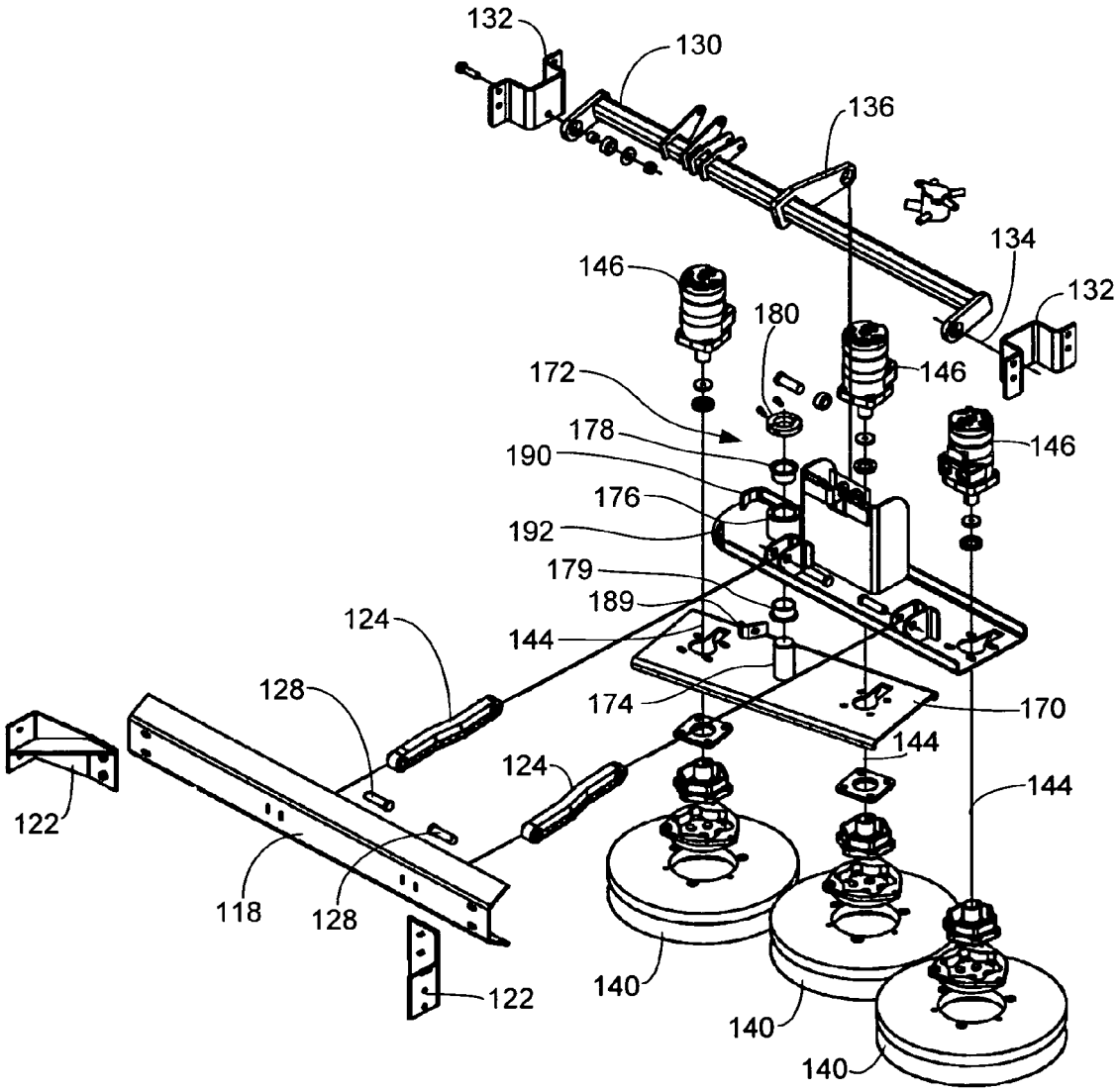
FIG. 3 is an exploded perspective view of a scrub head in accordance with embodiments of the invention.

Various embodiments of the scrub head 100 are depicted in FIGS. 2 and 3. FIG. 2 is a perspective view of the scrub head mounted to the frame, which is shown in phantom. The wheels 106, frame housing, and other components have been removed to simplify the illustration. FIG. 3 is an exploded perspective view of the scrub head 100 and components that mount the scrub head to the frame 104 of the cleaner 102.

The scrub head 100 can attach to the frame 104 in any suitable manner. In one embodiment, the scrub head 102 includes a pivotal connection 116 to a cross-support member 118 that is connected to side members 120 of the frame 104 with brackets 122. The pivotal connection 116 includes a pair of arms 124 that that are pivotally connected to the cross-support 118 and a main support 126 of the scrub head by pins 128 or other suitable means. A rotatable cross-support member 130 attaches to the side members 120 of the frame 104 at brackets 132 and is configured to rotate about an axis 134. The member 130 is connected to the main support 126 of the scrub head 100 through member 136. The rotation of the cross-support member 130 about the axis 134 causes the scrub head 100 to be raised from the floor for non-cleaning transport or lowered to the floor for cleaning operations, depending on the direction of rotation. The rotation of the cross-support can be motor driven or manually driven.

One embodiment of the scrub head 100 includes at least two disc scrub members, generally designated as 140, such as disc scrub brushes or pads. Each of the disc scrub members 140 are configured to rotate about a vertical axis 144 (FIG. 3) and are driven by motors 146. The disc scrub members 140 (i.e., the bottom surfaces) are generally oriented in a horizontal plane that is transverse to the vertical axes 144.

One embodiment of the present invention is directed to the ability to move one or more of the disc scrub members (movable disc scrub member) in the horizontal plane relative to at least one of the other disc scrub members to position the movable scrub member where it can be easily accessed by an operator of the cleaner for inspection and/or removal, or to adjust the configuration of the scrub head 100.

It should be understood that the following discussion of movement of the movable disc scrub member in or along the horizontal plane, does not necessarily mean that the movable disc scrub member moves solely in the horizontal plane. Instead, the movable disc scrub member can also move in a vertical plane that is transverse to the horizontal plane while it also travels along or in the horizontal plane. In other words, movement along the horizontal plane is intended to mean that at least one component of the movement of the movable disc scrub member is along the horizontal plane.

Figure 4:
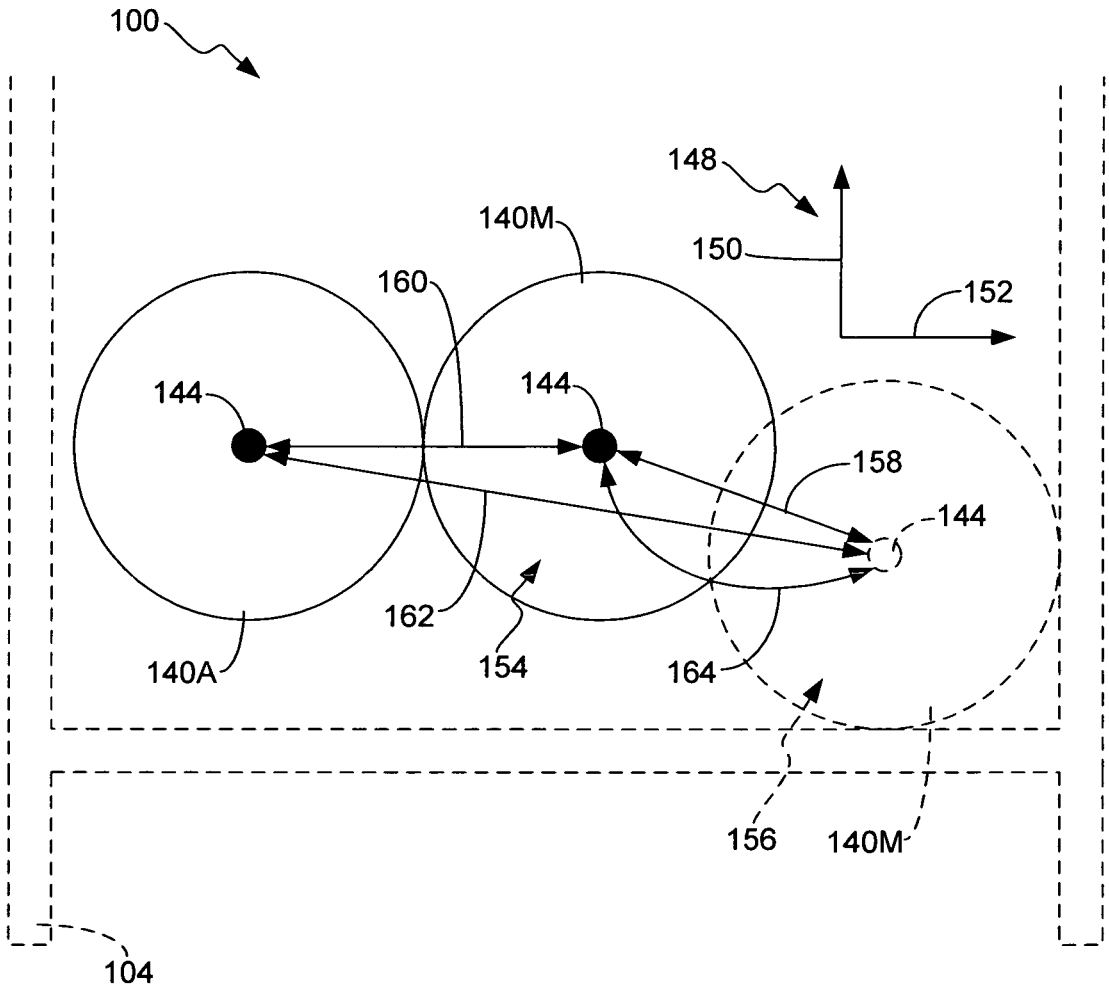
FIG. 4 is a simplified top view of a scrub head depicting first and second positions of a movable disc scrub member, in accordance with embodiments of the invention.

FIG. 4 is a simplified top view of the scrub head, in accordance with various embodiments of the invention. An exemplary frame 104 of the cleaner 102 is depicted in phantom. The horizontal plane 148 is defined by axes 150 and 152 and is transverse to the vertical axes 144, about which each of the disc scrub members 140 rotate.

In one embodiment, the scrub head 100 supports a movable disc scrub member 140M in a first position 154, shown in solid lines, and in a second position 156, shown in phantom. The second position 156 is displaced a distance 158 along the horizontal plane from the first position 154. Of course, as mentioned above, the movable disc scrub member 140M can also move along a vertical plane that is transverse to the horizontal plane 148 as it moves from the first position 154 to the second position 156.

When in the first position 154, the movable disc scrub member 140M is displaced a first distance 160 from the disc scrub member 140A along the horizontal plane 148. When in the second position 156 the movable disc scrub member 140M is displaced a second distance 162 from the disc scrub member 140A along the horizontal plane 148.

In one embodiment, the distance 158 the movable scrub member 140M moves from the first position 154 to the second position 156, or the displacement difference between the first and second distances 160 and 162, is greater than 4 inches. Additional embodiments include displacement differences between the first and second positions 154 and 156 relative to the disc scrub member 140A of greater than 6 inches, greater than 8 inches, greater than 10 inches, greater than 12 inches, greater than 18 inches, and greater than 24 inches.

In accordance with other embodiments, the second position 156 is displaced relative to the first position 154 and the disc scrub member 140A, along only the axis 150 of the horizontal plane 148, along only the axis 152 of the horizontal plane 148, or along both axes 150 and 152 of the horizontal plane 148 (shown in FIG. 4). In one embodiment, the distance 158 includes a displacement of greater than 4 inches along the axis 150 and a distance of greater than 4 inches along the axis 152. Other embodiments include combined displacements of the movable disc scrub member 140M relative to the first position 154 and the disc scrub member 140A along the axes 150 and 152 that result in the displacement differences described above.

The movement of the movable member 140M from the first position 154 to the second position 156 can be performed in many different ways. In one embodiment, the movable disc scrub member 140M moves substantially nonlinearly (i.e., not along a straight line), such as along an arc illustrated by arrow 164. In another embodiment, the movable disc scrub member 140M moves substantially linearly (i.e., along a straight line) from the first position 154 to the second position 156. In yet another embodiment, the movable disc scrub member 140M moves both linearly and non-linearly from the first position 154 to the second position 156.

The particular method of implementing the linear and/or nonlinear movement of the movable disc scrub member 140M described above can be in accordance with conventional mechanical techniques that are suitable for the scrub head 100.

In one embodiment, the scrub head 100 includes a movable support 170, to which the movable disc scrub member 140M is attached. The movable support can comprise several different components to provide the desired movement. The movable support includes at least one movable component that is movable (i.e., linearly and/or nonlinearly) between first and second positions that respectively correspond to the first and second positions 154 and 156 of the movable disc scrub member 140M. In other words, the movable disc scrub member 140M is in the first position 154 when the movable support (or a component thereof) is in the first position, and the movable disc scrub member 140M is in the second position 156 when the movable support is in the second position.

The scrub head 100 can provide separate supports for the disc scrub members 140 that are attached to the frame 104, or include the main support 126 that supports the disc scrub members 140 and is attached to the frame 104, as shown in FIG. 2.

Figure 5:
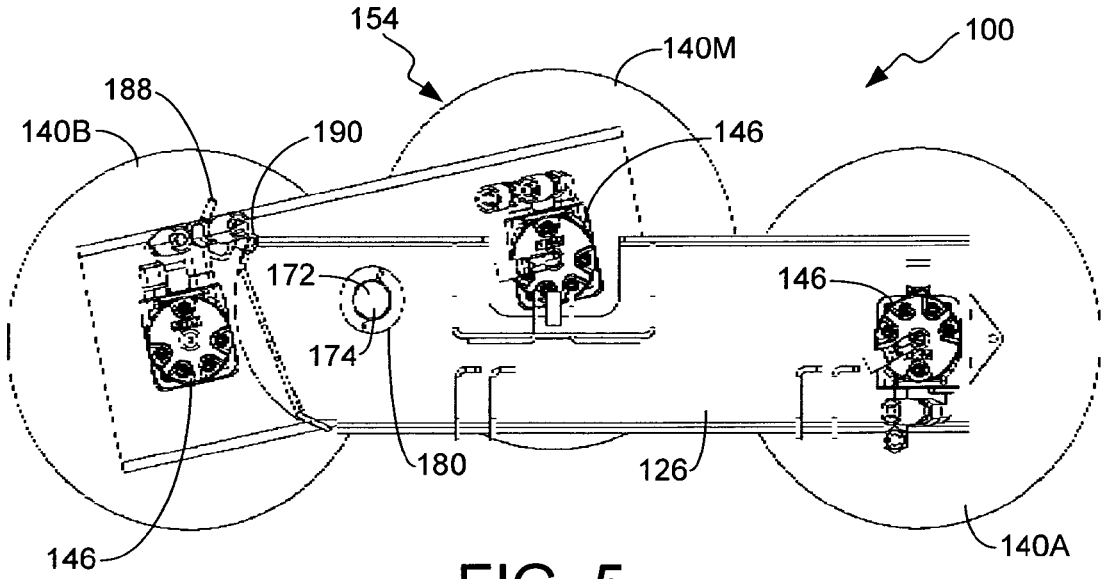
FIGS. 5 and 6 are top views of a scrub head respectively illustrating first and second positions of a movable disc scrub member, in accordance with embodiments of the invention.
Figure 6:
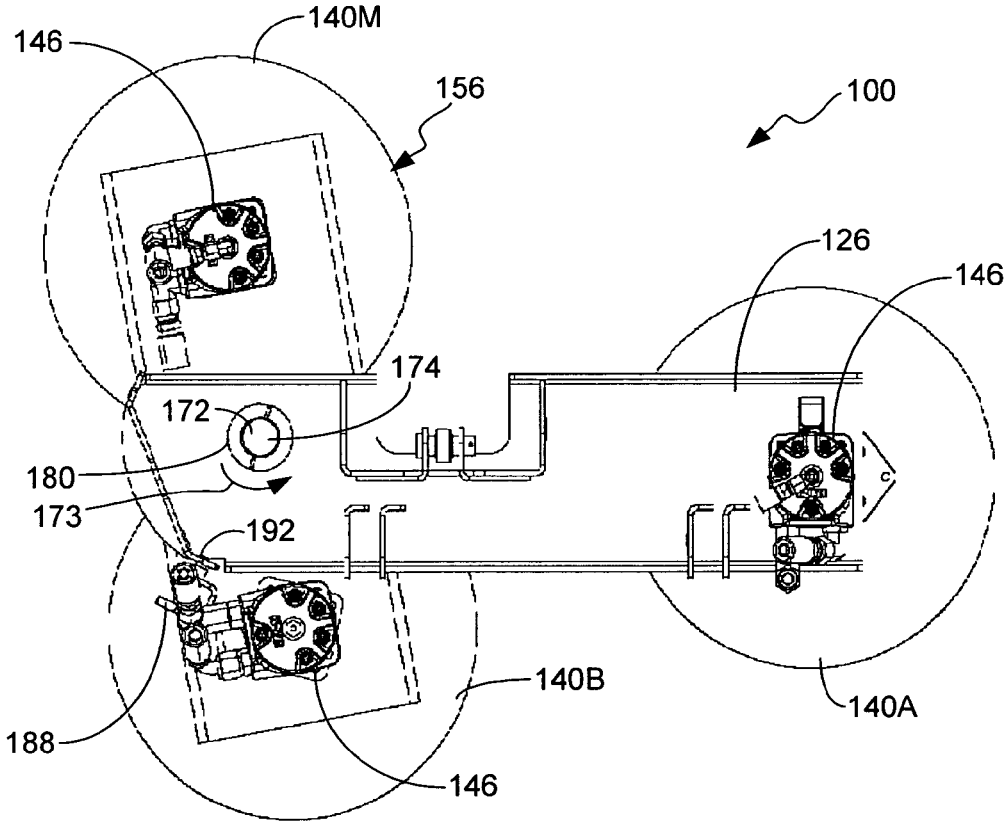

In one embodiment, the movable support 170 is connected to the main support, as shown in the top views of the scrub head 100 provided in FIGS. 5 and 6. The movable disc scrub member 104M is in the first position 154 in FIG. 5 and in the second position 156 in FIG. 6. Accordingly, the movable disc scrub member 140M is supported by both the main support 126 and the movable support 170 in this embodiment.

In one embodiment a pivotal or rotatable connection 172 is formed between the movable support 170 and the main support 126 that allows the movable support 170 to rotate relative to the main support 126, as indicated by arrow 173. The pivotal connection can be formed in accordance with many different methods.

In one embodiment, shown best in FIG. 3, the pivotal connection 172 includes a stem 174 attached to the movable support 170 that extends through a sleeve 176 of the main support 126. The stem 174 also extends through upper and lower flange and thrust bearings 178 and 179 that are seated in the sleeve 176. A retainer collar 180 attaches to the end of the stem 174 to hold the stem 174 and the movable support 170 in the desired vertical position relative to the main support 126.

In one embodiment, the scrub head 100 can lock the movable support 170 in a first position 184 (e.g., during cleaning operations) and release the movable support 170 for movement to a second position 186 (e.g., for inspection of the movable disc scrub member) that respectively corresponds to the first and second positions 154 and 156 of the movable disc scrub member 140M. The locking of the movable support 170 can be facilitated by a latch or other suitable mechanism that can be released by the operator, preferably by hand (i.e., without the need for tools), to allow movement of the movable disc scrub member 140M to the second position 156.

One exemplary latch, shown in FIGS. 3 and 5, includes a spring-loaded pin 188 that is mounted to the movable support 170. The pin can be inserted through a slot in a bracket 189 mounted to movable support 170 and a slot in a bracket 190 mounted to the main support 126 to lock the movable disc scrub member 140M and the movable support 170 in their first positions, and removed from the slot to free the movable support 170 for movement to the second position 186.

In another embodiment, the scrub head 100 can lock the movable support 170 in the second position 186 and release the movable support 170 for movement back to the first position 184. As above, the locking of the movable support 170 can be facilitated by a latch or other suitable mechanism that can be released by the operator to allow movement of the movable disc scrub member 140M to the first position 154. For example, another bracket 192 can be mounted to the main support 126. The pin 188 is inserted through the brackets 189 and 192 to lock the movable support 170 in the second position 186. Removal of the pin 188 from the bracket 192 releases the movable support 170 and allows the movable support 170 to move back to the first position 184.

Figure 7:
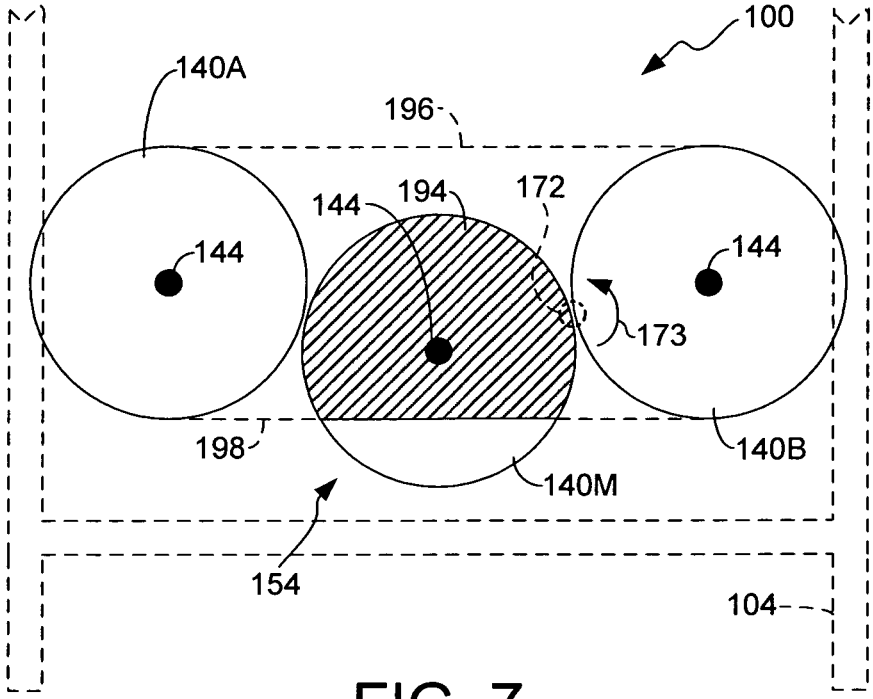
FIGS. 7 and 8 are simplified top views of a scrub head respectively illustrating first and second positions of a movable disc scrub member, in accordance with embodiments of the invention.
Figure 8:
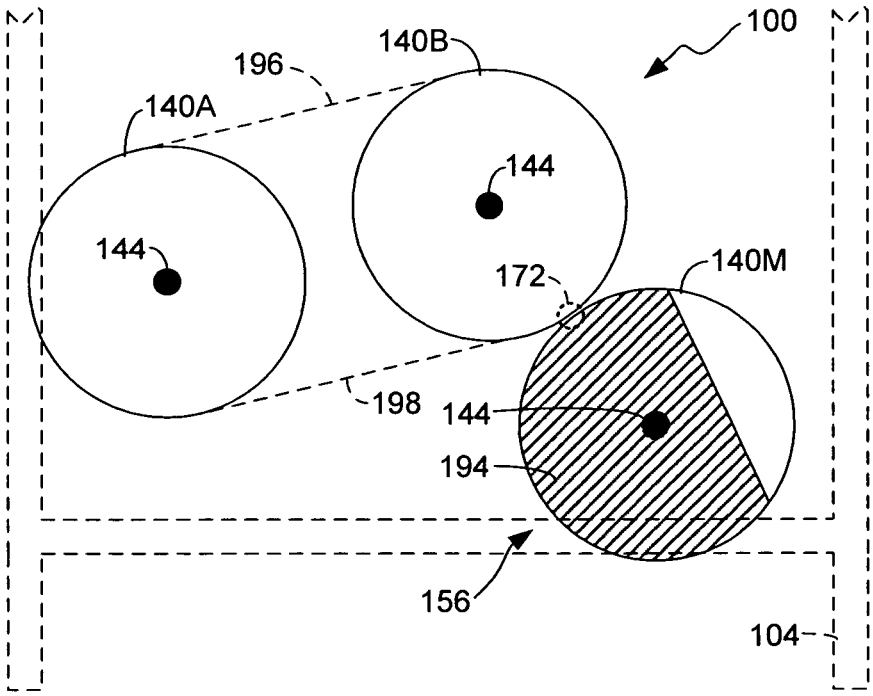

In one embodiment, the scrub head 100 includes at least three disc scrub members 140A, 140B and 140M, as shown in FIGS. 7 and 8. FIGS. 7 and 8 are simplified top views of the scrub head 100. In one embodiment, a portion 194 (shown in crosshatch) of the movable disc scrub member 140M is positioned between the disc scrub members 140A and 140B when in the first position 154, as shown in FIG. 7. In other words, the portion 194 of the movable disc scrub member 140M is within the space that is directly between the disc scrub members 140A and 140B, the boundaries of which are depicted by phantom lines 196 and 198.

In another embodiment, when the movable disc scrub member 140M is moved from the first position 154 to the second position 156, the portion 194 of the movable disc scrub member 140M is no longer between the disc scrub members 140A and 140B, as shown in FIG. 8. Thus, in one embodiment, a different portion of the movable disc scrub member 140M can be positioned between the disc scrub members 140A and 140B when the movable disc scrub member 140M moves to the second position 156. In another embodiment, none of the portion 194 of the movable disc scrub member 140M is between the disc scrub members 140A and 140B when in the second position 156, as shown in FIG. 8.

In one embodiment, the movable disc scrub member 140M and at least one other disc scrub member, such as 104B, is mounted to the movable member 170. In one embodiment, the disc scrub member 140B is mounted to an opposing side of the pivotal connection 172, as shown in FIGS. 5 and 6. As a result, the disc scrub member 140B also includes first and second positions that are displaced different amounts along the horizontal plane 148 relative to the disc scrub member 140A and/or the frame 104.

When the first position 154 of the movable disc scrub member 140M places it in a central location beneath the cleaner 102, as indicated by the frame 104 in FIG. 7, it is generally difficult to inspect and/or replace the disc scrub member 140M because the operator is forced to either place the cleaner 102 on a lift or crawl underneath the cleaner 102 to gain access to the disc scrub member 140M. In one embodiment, the second position 156 is located closer to a side of the cleaner 102, which provides the operator with easier access to the disc scrub member 140M. As a result, one embodiment of the invention is directed to the ability to move the disc scrub member 140M relative to the frame 104, from a first position 154 that is relatively more beneath the cleaner 102 to a second position 156 that is closer to a side of the cleaner 102, as shown in FIG. 8. Once the disc scrub member 140M has been inspected or replaced, it can be returned to the first position 154.

Such movement is distinguishable from conventional scrub heads that can move a small distance one direction within the horizontal plane. The disc scrub members of such scrub heads move as a unit rather than independently relative to each other. Such movement is for the purpose of allowing the cleaner to perform a cleaning operation against or near a wall. Unfortunately, even when the scrub head is shifted to a side of the cleaner the maximum amount (approximately 6 inches), it provides little improvement to the accessibility of the centrally located disc scrub member beneath the cleaner due to various structures of the scrub head and cleaner.

The scrub head 100 of the present invention can also be used to change the configuration of the scrub head. For example, the movement of the movable disc scrub member 140M from the first position 154 to the second position 156 can make room for the mounting of additional scrub members 140 to the scrub head 100 to increase the width of its scrubbing swath. Similarly, the movement of the movable disc scrub member 140M form the second position 156 to the first position 154 can make the scrubbing swath of the scrub head 100 more compact.

Although the present invention has been described with reference to preferred embodiments, workers skilled in the art will recognize that changes may be made in form and detail without departing from the spirit and scope of the invention. For example, although the depicted cleaner is a riding cleaner, the scrub head of the present invention can be used with walk-behind floor cleaners as well.

What is claimed is:

1. A scrub head configured for attachment to a frame of a mobile floor cleaner, the scrub head comprising:

a main support;

a first disc scrub member attached to the main support and rotatable about a first vertical axis, wherein a portion of the main support overhangs the first disc scrub member;

a movable support pivotally connected to the main support and having first and second positions;

a movable disc scrub member rotatable about a second vertical axis and connected to the movable support, the movable disc scrub member configured to move relative to the first disc scrub member along first and second orthogonal axes of a horizontal plane, which is transverse to the first and second vertical axes, between first and second positions respectively corresponding to the first and second positions of the movable support; and a locking mechanism configured to lock the movable support in the first position and fix the relative positions of the first disc scrub member and the movable disc scrub member.

2. The scrub head of claim 1, wherein the movable disc scrub member is configured to move in an arc along the horizontal plane.

3. The scrub head of claim 1, wherein the first and movable disc scrub members each include one of a disc brush and a disc pad.

4. The scrub head of claim 1, wherein the movable disc scrub member is located a first distance from the first disc scrub member when in the first position and the movable disc scrub member is located a second distance from the first disc scrub member when in the second position, the first and second distances are measured along the horizontal plane, and a difference between the first and second distances is greater than 4 inches.

5. The scrub head of claim 1, including a second disc scrub member, wherein a portion of the movable disc scrub member is positioned between the first and second disc scrub members when the movable disc scrub member is in the first position.

6. The scrub head of claim 5, wherein the portion of the movable disc scrub member is not positioned between the first and second disc scrub members when the movable disc scrub member is in the second position.

7. The scrub head of claim 6, wherein the second disc scrub member is connected to the movable support.

8. A mobile floor cleaner comprising:

a frame supported on wheels; and a scrub head positioned underneath the frame, the scrub head comprising:

a main support connected to the frame;

a first disc scrub member attached to the main support and rotatable about a first vertical axis, wherein a portion of the main support overhangs the first disc scrub member;

a movable support pivotally connected to the main support and having first and second positions;

a movable disc scrub member rotatable about a second vertical axis and connected to the movable support, the movable disc scrub member configured to move relative to the first disc scrub member along first and second orthogonal axes of a horizontal plane, which is transverse to the first and second vertical axes, between first and second positions respectively corresponding to the first and second positions of the movable support; and a locking mechanism configured to lock the movable support in the first position and fix the relative positions of the first disc scrub member and the movable disc scrub member; and a vacuum pickup squeegee supported by the frame on a rear side of the scrub head.

9. The mobile floor cleaner of claim 8, wherein the movable disc scrub member is configured to move in an arc along the horizontal plane.

10. The mobile floor cleaner of claim 8, wherein the first and movable disc scrub members each include one of a disc brush and a disc pad.

11. The mobile floor cleaner of claim 8, wherein the movable disc scrub member is located a first distance from the first disc scrub member when in the first position and the movable disc scrub member is located a second distance from the first disc scrub member when in the second position, the first and second distances are measured along the horizontal plane, and a difference between the first and second distances is greater than 4 inches.

12. The mobile floor cleaner of claim 8 including a second disc scrub member, wherein a portion of the movable disc scrub member is positioned between the first and second disc scrub members when the movable disc scrub member is in the first position.

13. The mobile floor cleaner of claim 12, wherein the portion of the movable disc scrub member is not positioned between the first and second disc scrub members when the movable disc scrub member is in the second position.

14. The mobile floor cleaner of claim 13, wherein the second disc scrub member is connected to the movable support.

15. A scrub head configured for attachment to a frame of a mobile floor cleaner, the scrub head comprising:

a main support;

a first disc scrub member attached to the main support and rotatable about a first vertical axis;

a movable support configured to move between first and second positions;

a second disc scrub member attached to the movable support and rotatable about a second vertical axis, the second disc scrub member moves relative to the first disc scrub member in a horizontal plane that is transverse to the first and second vertical axes responsive to movement of the movable support; and a third disc scrub member attached to the movable support and configured to rotate about a third vertical axis, the third disc scrub member moves relative to the first disc scrub member in the horizontal plane responsive to movement of the movable support.

16. The scrub head of claim 15, wherein the second disc scrub member and the third disc scrub member are configured to move in an arc in the horizontal plane.

17. The scrub head of claim 15, wherein the movable support is pivotally connected to the main support.

18. The scrub head of claim 15, wherein:

a portion of the third disc scrub member is positioned between the first and second disc scrub members when the movable support is in the first position; and the portion of the third disc scrub member is not positioned between the first and second disc scrub members when the movable support is in the second position.

19. The scrub head of claim 7, wherein:

the movable disc scrub member is centrally positioned underneath the frame when the movable disc scrub member is in the first position; and the movable disc scrub member is positioned closer to a side of the frame when the movable disc scrub member is in the second position relative to when the movable disc scrub member is in the first position.

20. The scrub head of claim 15, wherein a portion of the main support directly overhangs the first disc scrub member, the second disc scrub member and the third disc scrub member.

21. A mobile floor cleaner comprising:

a frame supported on wheels; and a scrub head positioned underneath the frame comprising:

a main support connected to the frame;

a movable support attached to the main support and configured to pivot about a vertical support axis relative to the main support;

a first disc scrub member supported by the main support and rotatable about a first vertical axis;

a second disc scrub member supported by the main support and rotatable about a second vertical axis;

a third disc scrub member attached to the movable support and rotatable about a third vertical axis, the third disc scrub member configured to move relative to the first and second disc scrub members responsive to rotation of the movable support about the support axis; and a locking mechanism configured to lock the relative positions of the first, second and third disc scrub members in a cleaning position, in which the first, second and third disc scrub members are configured to clean a continuous swath of floor surface extending across the width of the frame.

22. The mobile floor cleaner of claim 21, wherein the second disc scrub member is positioned between the first and third disc scrub members when the first, second and third disc scrub members are locked in the cleaning position.

23. The mobile floor cleaner of claim 22, wherein the first, second and third disc scrub members are not configured to perform a floor cleaning operation on a floor surface that is not directly underneath the frame.

* * * * *